US007474052B2

(12) United States Patent
Park et al.

(10) Patent No.: US 7,474,052 B2
(45) Date of Patent: Jan. 6, 2009

(54) PLASMA DISPLAY PANEL WITH DISPLAY ELECTRODES FORMED IN INTERSECTING PORTIONS

(75) Inventors: Sung Yeol Park, Kyungki-do (KR); Byeung Gyu Chang, Kyungki-do (KR); Ki Pyo Hong, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 515 days.

(21) Appl. No.: 11/194,473

(22) Filed: Aug. 2, 2005

(65) Prior Publication Data

US 2006/0170345 A1 Aug. 3, 2006

(30) Foreign Application Priority Data

Feb. 3, 2005 (KR) ..... 10-2005-0010079

(51) Int. Cl.
*H01J 17/49* (2006.01)

(52) U.S. Cl. ..... 313/582; 313/292

(58) Field of Classification Search ..... 313/582–587, 313/292; 315/169.4
See application file for complete search history.

(56) References Cited

U.S. PATENT DOCUMENTS

| | | | | |
|---|---|---|---|---|
| 5,744,909 | A * | 4/1998 | Amano | 313/585 |
| 6,646,378 | B2 * | 11/2003 | Kanda | 313/582 |
| 6,650,062 | B2 * | 11/2003 | Inoue et al. | 315/169.3 |
| 6,847,165 | B2 * | 1/2005 | Sung et al. | 313/587 |
| 2004/0245929 | A1 * | 12/2004 | Sakamoto | 313/584 |
| 2005/0093444 | A1 * | 5/2005 | Woo et al. | 313/582 |

FOREIGN PATENT DOCUMENTS

| | | | |
|---|---|---|---|
| JP | 2000-331615 | A | 11/2000 |
| JP | 2003-197106 | A | 7/2003 |
| JP | 2004-179099 | A | 6/2004 |
| JP | 2005-135893 | A | 5/2005 |
| JP | 2005-339937 | A | 12/2005 |

OTHER PUBLICATIONS

Japanese Office Action, w/ English translation thereof, issued in Japanese Patent Application No. 2005-231897 dated on Sep. 16, 2008.

* cited by examiner

*Primary Examiner*—Toan Ton
*Assistant Examiner*—Hana A Sanei
(74) *Attorney, Agent, or Firm*—McDermott Will & Emery LLP

(57) ABSTRACT

Provided herein is a plasma display panel. The plasma display panel comprises a front substrate, a rear substrate opposite to the front substrate and having address electrodes formed thereon, a lattice-shaped partition wall formed between the front substrate and the rear substrate, a phosphor applied to a discharge space partitioned by the partition wall, and a plurality of scanning electrodes and common electrodes formed in intersection regions of the partition wall and extending perpendicular to the front substrate. The plasma display panel has a sufficient aperture ratio, and thus has enhanced light emitting efficiency. The scanning electrodes and the common electrodes formed in the intersection regions of the partition walls have a vertical construction, thereby effectively preventing the phosphor from being damaged by the plasma. Discharge uniformly occurs at the outer periphery of the discharge cell, thereby inducing effective excitation of the phosphor.

10 Claims, 3 Drawing Sheets

PLASMA DISPLAY PANEL WITH DISPLAY ELECTRODES FORMED IN INTERSECTING PORTIONS

RELATED APPLICATION

The present invention is based on, and claims priority from, Korean Application Number 2005-10079, filed Feb. 3, 2005, the disclosure of which is incorporated by reference herein in its entirety.

BACKGROUND OF THE INVENTION

1. Field of the Invention

The present invention generally relates to a plasma display panel, and, more particularly, to a plasma display panel, designed to reduce phosphor damage and to have enhanced light emitting efficiency upon discharge.

2. Description of the Related Art

Recently, plasma display apparatuses employing plasma display panels (PDPs) have been spotlighted as substitutes for cathode-ray tube display apparatuses. Such PDPs generally comprise two substrates having a plurality of electrodes formed thereon, a discharge gas sealed in a space between the substrates, and phosphors arranged in a predetermined pattern. When a discharge voltage is applied to the plurality of electrodes, the discharge gas is excited into plasma. Ultraviolet rays emitted through an ionization phenomenon of the plasma cause the phosphors of the predetermined pattern to be excited, thereby providing a desired image.

The PDPs can be classified into AC-type PDPs and DC-type PDPs according to their discharge manner. In the DC-type PDPs, the electrodes are exposed to a discharge space in a plasma state, so that conduction current directly flows through the corresponding electrodes. On the other hand, in the AC-type PDPs, at least one electrode is embedded in a dielectric layer, and discharge occurs by virtue of electric field of wall charges, instead of direct conduction of charges between corresponding electrodes.

FIG. 1*a* is an exploded perspective view schematically illustrating a conventional PDP, and FIG. 1*b* is a cross-sectional view of the conventional PDP shown in FIG. 1*a*. For convenience of description, FIG. 1*b* shows a lower panel 60 rotated 90°.

Referring to FIGS. 1*a* and 1*b*, the PDP 10 comprises an upper panel 50 for displaying an image, and the lower panel 60 coupled in parallel to the upper panel 50. The upper panel 50 comprises a front substrate 11, and sustain electrode pairs 12, each including a scanning electrode 31 and a common electrode 32 disposed in the front substrate 11. The lower panel 60 comprises a rear substrate 21, and address electrodes 22 disposed on the rear substrate 21 so as to lie across the sustain electrode pairs 12. Both the scanning electrode 31 and the common electrode 32 comprise a transparent electrode 31*a* or 32*a* formed of transparent ITO, and a bus electrode 31*b* or 32*b* formed of a metallic material. The scanning electrode 31 and common electrode 32 pair and the address electrodes 22 lying across the scanning electrode 31 and the common electrode 32 pair constitute a discharge region as a unit discharge cell.

Moreover, a front dielectric layer 15 and a rear dielectric layer 25 for embedding the respective electrodes therein are formed on the front substrate 11 and the rear substrate 12, respectively. A transparent protective film 16 typically formed of MgO is formed on a rear side of the front dielectric layer 15, and partition walls 30 are formed on a front side of the rear dielectric layer 25 for maintaining a discharge distance and preventing electrical and optical cross-talk between the discharge cells. Red, green and blue phosphors 26 are applied to opposite sides of each partition wall 30, and on an upper surface of the rear dielectric layer 25. Meanwhile, an inert mixing gas, such as Ne, Ar, Xe and the like, are sealed in a discharge space between the partition walls 30.

Upon operation of the PDP, as a driving voltage is applied to the sustain electrode pairs 12, surface discharge occurs in the discharge region under the transparent protective film 16. In such surface discharge, ultraviolet radiation is generated by virtue of the ionization phenomenon of the plasma. The ultraviolet radiation excites the surrounding phosphors 26, whereby visible light is generated, and provides a desired image.

In such a conventional PDP, there is a problem in that the phosphors 26 are damaged and then deteriorated due to collision of ions caused by the plasma generated upon the discharge. Moreover, due to the sustain electrode pairs 12 extended in a strip shape (especially, due to the bus electrodes 31*b* and 32*b*), it is difficult to secure a sufficient aperture ratio, thereby reducing light emitting efficiency. Additionally, since the upper panel 50 is provided with the front substrate 11 together with the front dielectric layer 15 for allowing the sustain electrode pairs 12 to be embedded therein, the overall transmittance of the upper panel 50 is lowered. Thus, in order to prevent the transmittance of the upper panel 50 from being lowered, the rate of dependency on materials for the sustain electrode pairs 12, the front dielectric layer 15 and the front substrate 11 is increased.

In order to prevent the phosphors from being damaged due to the plasma upon operation of the PDP, Japanese Patent Laid-open Publication No. (Hei) 2004-179099 discloses a method for applying a phosphor-protecting film consisting of $SiO_2$ as a main component on a surface of the phosphor. However, according to the method of the disclosure, it is difficult to uniformly apply the phosphor-protecting film to the phosphor, and an additional discharge gas must be used for facilitating passage of ultraviolet radiation through the phosphor-protecting film.

SUMMARY OF THE INVENTION

The present invention has been made to solve the above problems, and it is an object of the present invention to provide a plasma display panel, designed to suppress plasma-induced phosphor damage, to enhance light emitting efficiency, and to increase the variety of materials which may be used to fabricate an upper panel.

In accordance with one aspect of the present invention, the above and other objects can be accomplished by the provision of a plasma display panel, comprising: a front substrate; a rear substrate opposite to the front substrate and having address electrodes formed thereon; partition walls formed to have a lattice shape between the front substrate and the rear substrate; a phosphor applied to a discharge space partitioned by the partition wall; and a plurality of scanning electrodes and common electrodes formed in intersection regions of the partition walls and extending perpendicular to the front substrate. The plasma display panel may further comprise a rear dielectric layer for embedding the address electrodes within the rear substrate so as to protect the address electrodes.

The scanning electrodes and the common electrodes may be alternately disposed in longitudinal and transverse directions in the intersection regions. In this case, a discharge region may be formed between the scanning electrodes and the common electrodes adjacent to each other, and may surround the discharge space partitioned by the partition walls.

The partition walls may constitute a lattice surrounding the discharge space having a rectangular cross-section, and the scanning electrodes and the common electrodes may be disposed in the intersection regions of the partition walls.

Each of the partition walls may comprise an electrode protecting layer for embedding the scanning electrodes and the common electrodes. The electrode protecting layer may act to protect the scanning electrodes and the common electrodes from plasma, and may comprise a dielectric layer for guiding charges and accumulating wall charges. Moreover, the partition wall may further comprise a lower partition wall formed between the rear substrate and the electrode protecting layer. Alternatively, each of the partition walls may be formed as a unitary member. That is, each of the partition walls may consist of the electrode protecting layer for embedding the scanning electrodes and the common electrodes. In this manner, the construction of the partition walls is very simplified, whereby the partition walls can be easily manufactured. Moreover, the plasma display panel may further comprise an MgO protection film formed at a portion exposed to the discharge space in order to protect the electrode protecting layer from the plasma. Moreover, an MgO protection film may be formed on a rear side of the front substrate in order to protect the front substrate from the plasma.

The invention provides an approach for suppressing plasma-induced phosphor damage, realizing enhanced light emitting efficiency, and increasing the variety of materials which may be used to fabricate the upper panel. For this purpose, the scanning electrodes and the common electrodes are disposed perpendicular to the front substrate in the intersection regions of the lattice-shaped partition walls. As such, the plasma display panel of the invention is provided with the scanning electrodes and the common electrodes having the vertical construction, so that the phosphor can be effectively protected from the plasma, and the light emitting efficiency can be enhanced by securing a sufficient aperture ratio. Further, unlike the conventional PDP having the scanning electrodes and the common electrodes disposed in the upper panel, since the scanning electrodes and the common electrodes are disposed in the intersection regions of the partition walls, the invention allows the upper panel of the PDP to be very simplified in construction as well as increasing the variety of materials which may be used to fabricate the upper panel.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Figure 1:
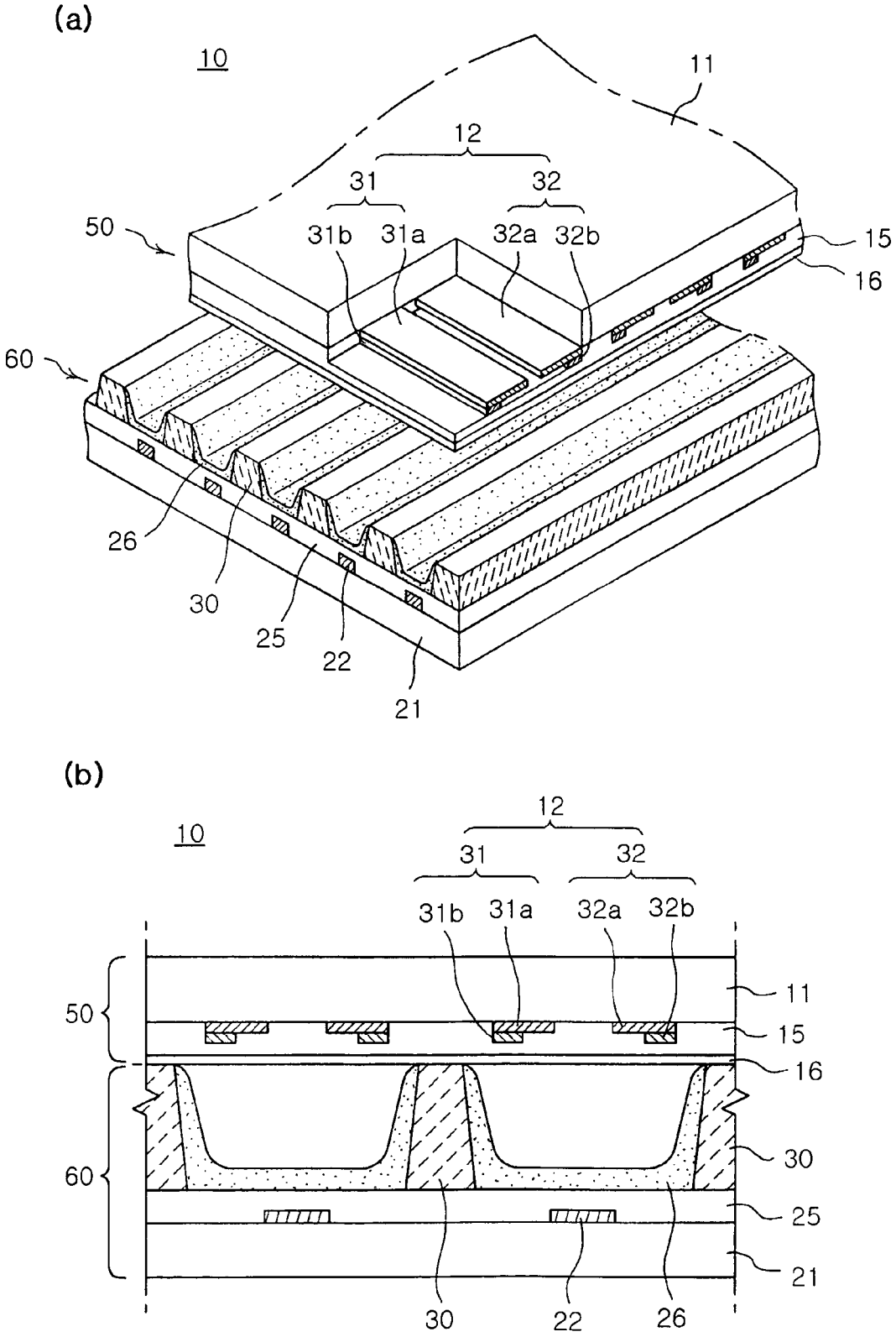
PRIOR ART FIG.1
FIG. 1*a* is an exploded perspective view schematically illustrating a conventional plasma display panel.
FIG. 1*b* is a cross-sectional view of the conventional plasma display panel shown in FIG. 1*a;*

Preferred embodiments will now be described in detail with reference to the accompanying drawings. It should be noted that the embodiments of the invention can be modified in various shapes, and that the present invention is not limited to the embodiments described herein. The embodiments of the invention are described so as to enable those having an ordinary knowledge in the art to have a perfect understanding of the invention. Accordingly, shape and size of components of the invention are enlarged in the drawings for clear description of the invention. Like components are indicated by the same reference numerals throughout the drawings.

Figure 2:
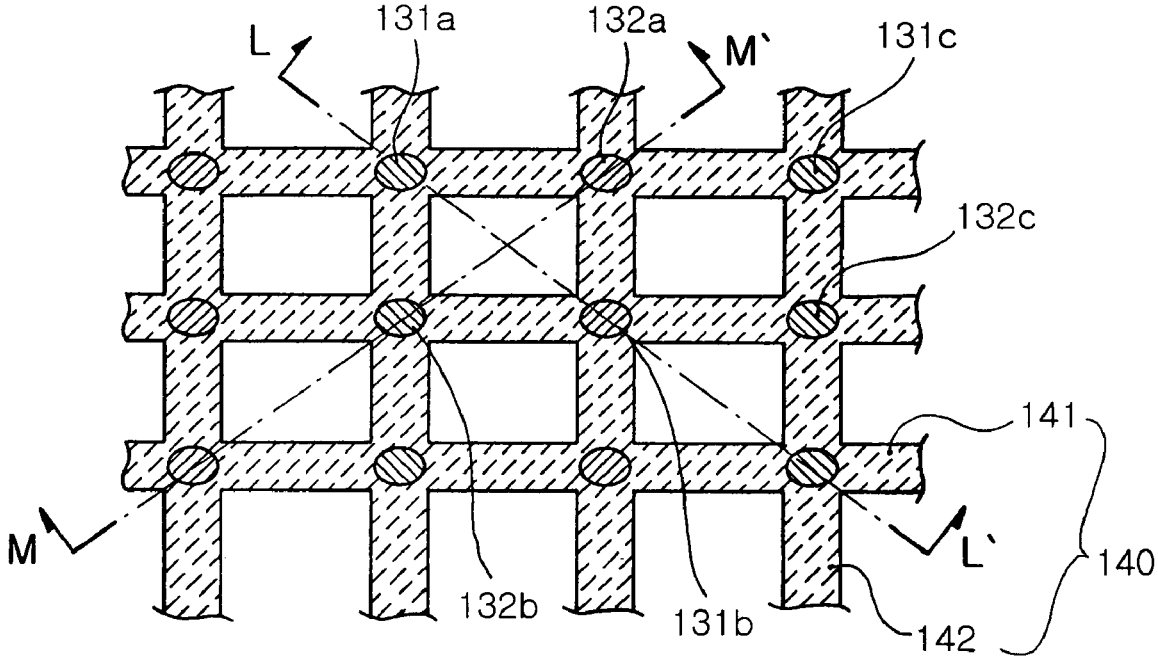
FIG. 2 is a schematic plan view illustrating a plasma display panel according to one embodiment of the present invention.

FIG. 2 is a schematic plan view illustrating a plasma display panel according to one embodiment of the invention. Referring to FIG. 2, the PDP comprises partition walls 140 constituting a lattice shape. Each of the partition walls 140 comprises first strip-shaped partition walls 141 disposed in parallel to each other in a transverse direction, and second strip-shaped partition walls 142 disposed in parallel to each other in a longitudinal direction across the first partition walls 141. The first and second partition walls 141 and 142 constitute a rectangular discharge space. The single discharge space surrounded by the partition wall 140 constitutes a unit discharge cell. The partition walls 140 may be formed of, for example, a dielectric material, and surround the rectangular discharge space. The first and second partition walls 141 and 142 cross each other at intersection regions. The first and second partition walls 141 and 142 are formed in order to prevent electrical and optical cross-talk between the discharge spaces. Although the first and second partition walls 141 and 142 are described as crossing each other in the present embodiment, the present invention is not limited to this construction. The shape of the lattice formed by the first and second partition walls may be modified in various shapes, and bent to a round shape.

Scanning electrodes 131*a*, 131*b* and 131*c*, and common electrodes 132*a*, 132*b* and 132*c* are formed in the intersection regions of the partition walls 140 to generate sustain discharge. Specifically, the plurality of common electrodes and scanning electrodes are alternately disposed in longitudinal and transverse directions in the intersection regions. The respective scanning electrodes 131*a*, 131*b* and 131*c* are electrically connected to each other via a wire (not shown), and the respective common electrodes 132*a*, 132*b* and 132*c* are also electrically connected to each other via another wire (not shown). Unlike the construction of the conventional PDP, the scanning electrodes 131*a*, 131*b* and 131*c*, and the common electrodes 132*a*, 132*b* and 132*c* of the invention do not have a strip shape. Instead, each of the electrodes of the invention is extended perpendicular to the front substrate (that is, perpendicular to the paper of FIG. 2) in an associated intersection region. As such, since the scanning and common electrodes are extended perpendicular to the front substrate in the intersection regions, a higher aperture ratio can be secured, thereby enhancing light emitting efficiency.

Figure 3:
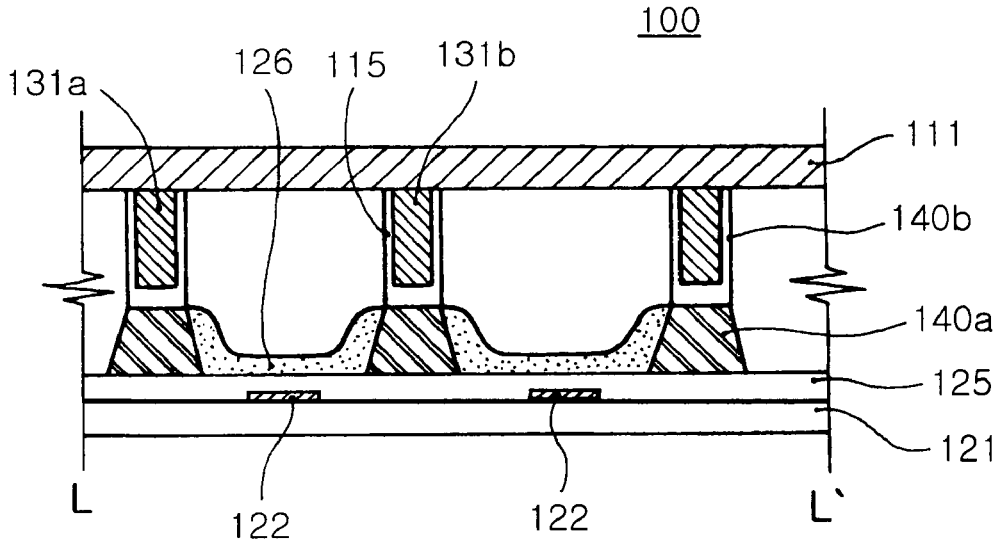
FIG. 3 is a cross-sectional view taken along line L-L' in FIG. 2.
Figure 4:
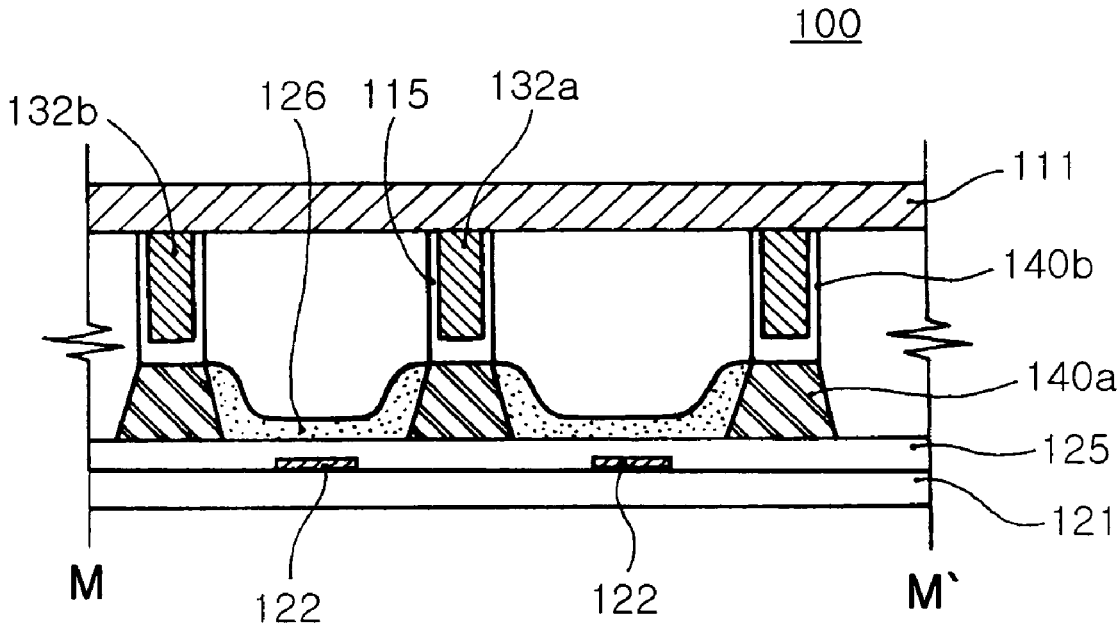
FIG. 4 is a cross-sectional view taken along line M-M' in FIG. 2.

FIG. 3 is a cross-sectional view taken along line L-L' in FIG. 2, and FIG. 4 is a cross-sectional view taken along line M-M' in FIG. 2. For convenience of description, a lower panel 121, 122 and 125 is shown in an inverted state to show cross-sections of address electrodes 122.

Referring to FIGS. 3 and 4, the plasma display panel 100 comprises a front substrate 111 constituting an upper panel, and a rear substrate 121 opposite to the front substrate 111. The front substrate 111 may be formed of a transparent material comprising glass as a main component. A plurality of address electrodes 122 are formed on the rear substrate 121, and extended in a strip shape thereon. The PDP 100 comprises a rear dielectric layer 125 for embedding the plurality of address electrodes 122, thereby protecting the plurality of address electrodes 122.

The partition walls 140 constituting the lattice-shaped (see FIG. 2) as described above are disposed between the front substrate 111 and the rear substrate 121. The scanning electrodes 131*a* and 131*b* and the common electrodes 132*a* and 132*b* are formed in the intersection regions of the partition walls 140. Particularly, in the present embodiment, each of the partition walls 140 comprises a lower partition wall 140*a*, and an electrode protecting layer 140*b* formed on the lower partition wall 140*a*. The electrode protecting layers 140*b* have the scanning electrodes 131*a* and 131*b* and the common electrodes 132*a* and 132*b* embedded therein, and act to protect the electrodes from the plasma. Each of the electrode protecting layers 140*b* may comprise a dielectric layer which can accumulate wall charges. Moreover, each of the electrode protecting layers 140*b* may be formed in a multilayer structure, and comprise an MgO protection film at a portion exposed to the discharge space, particularly in order to prevent damage of the electrode protecting layers 140*b* caused by the plasma.

As shown in FIGS. 3 and 4, unlike the conventional PDPs, the scanning electrodes and the common electrodes of the invention are disposed in the intersection regions of the partition walls instead of in the upper panel, thereby simplifying the construction of the upper panel. As a result, the upper panel of the invention substantially consists only of the front substrate 111. Accordingly, visible light emitted from the phosphor passes through the upper panel with a significantly higher transmittance, thereby providing a higher brightness. As such, since the upper panel of the invention has a simple construction while realizing an enhanced transmittance, and the variety of materials which may be used to fabricate the upper panel is increased. Preferably, an additional MgO protection film is formed on the rear side of the front substrate 111 in order to protect the front substrate 111 from the plasma.

Phosphors 126 for emitting red, green, and blue light are provided in the discharge spaces partitioned by the partition walls 140. The phosphors 126 are applied to both sides of the lower partition wall 140*a*, and to an upper surface of the rear dielectric layer 125. In order to minimize plasma-induced damage of the phosphors 126 during operation of the PDP 100, it is desirable that the lowermost end of the scanning electrodes 131*a* and 131*b* and the common electrodes 132*a* and 132*b* be located higher than the uppermost end of the phosphors 126. In other words, it is desirable that the phosphors 126 be provided at a position lower than the scanning electrodes and the common electrodes extending in the perpendicular direction, thereby minimizing the damage of the phosphors 126 by the plasma.

Operation of the plasma display panel 100 according to the invention will now be described as follows.

When an address voltage is applied between the address electrodes 122 and the scanning electrodes 131*a* and 131*b*, address discharge occurs, and a discharge cell for generating main discharge is selected based on the result of the address discharge.

Then, when a discharge sustain voltage is applied between the scanning electrodes 131*a* and 131*b* and the common electrodes 132*a* and 132*b* in the selected discharge cell, the main discharge occurs between the scanning electrodes 131*a* and 131*b* and the common electrodes 132*a* and 132*b*. When the main discharge occurs, an energy level of an excited discharge gas is lowered, thereby emitting ultraviolet radiation. This ultraviolet radiation excites the phosphors in the discharge cell, so that an energy level of the excited phosphor is lowered, thereby emitting red, green, and blue light.

Particularly, referring to FIG. 2, when a voltage is applied to the alternately disposed scanning electrodes 131*a* and 131*b* and common electrodes 132*a* and 132*b*, discharge occurs between the scanning electrode 131*a* and the common electrode 132*a*, between the common electrode 132*a* and the discharge electrode 131*b*, between the scanning electrode 131*b* and the common electrode 132*b*, and between the common electrode 132*b* and the scanning electrode 131*a*, whereby respective discharge regions surround a single discharge cell. Accordingly, the discharge uniformly occurs at an outer periphery of the discharge cell. The discharge uniformly occurring at an outer periphery of the discharge cell can generate uniform ultraviolet radiation, thereby effectively exciting the phosphors. Moreover, the main discharge is created between the scanning electrodes and the common electrodes embedded in the vertical construction in the intersection regions of the partition walls 140, the phosphors applied to a lower portion of the discharge cell are less damaged by the plasma. Additionally, since the scanning electrodes and common electrodes occupy a smaller horizontal area while extending in the horizontal direction, the PDP of the invention can achieve a higher light emitting efficiency.

In the embodiment described above, although the partition walls 140 have been described as comprising the lower partition wall 140*a* and the electrode protecting layer 140*b* formed on the lower partition wall 140*a*, the partition walls may be formed as a unitary member excluding the lower partition wall. In this case, the construction of the partition walls is very simplified, whereby the partition walls can be easily manufactured. An example of such partition walls 140*c* is shown in FIG. 5.

Figure 5:
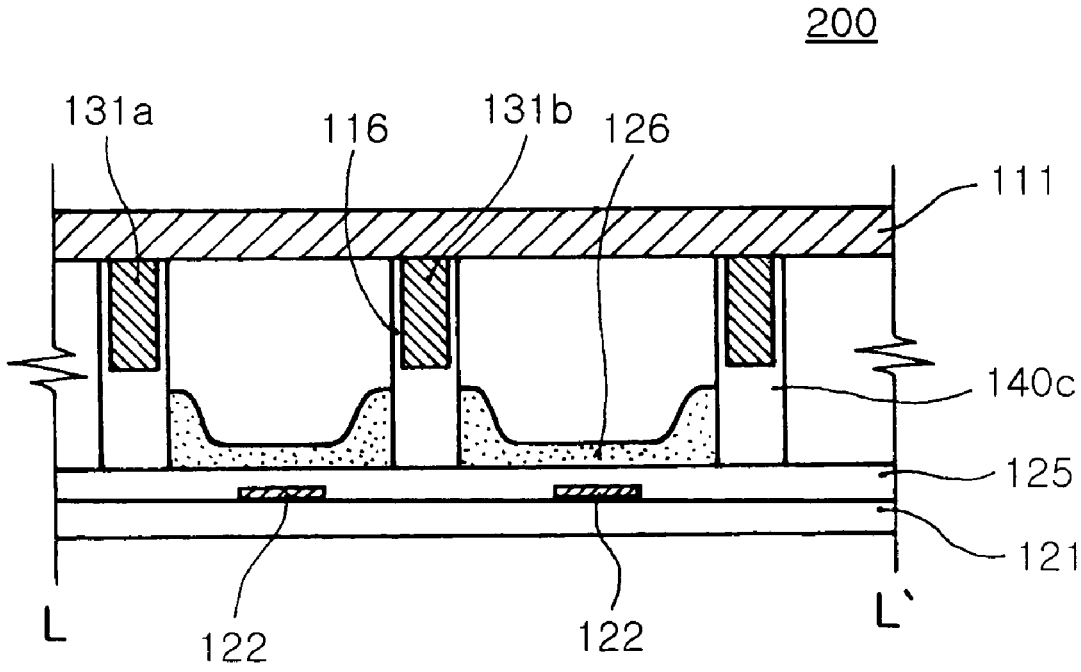
FIG. 5 is a cross-sectional view of a plasma display panel according to another embodiment of the present invention.

FIG. 5 is a cross-sectional view a PDP 200 according to another embodiment of the present invention. Particularly, FIG. 5 is a cross-sectional view taken along line L-L' of FIG. 2. Referring to FIG. 5, partition walls 140*c* are formed between a rear substrate 121 and a front substrate 111. Each of the partition walls 140*c* dividing respective discharge cells from each other is formed as the unitary member. The partition walls 140*c* consist of an electrode protecting layer for embedding scanning electrodes 131*a* and 131*b* and common electrodes 132*a* and 132*b* (see FIG. 2) excluding the separate lower partition wall. In the embodiment shown in FIG. 5, each of the partition walls 140*c* acting as the electrode protecting layer preferably comprises an MgO protection film at a portion exposed to the discharge space. The MgO protection film protects the partition wall 140*c* from the plasma while protecting the scanning electrodes 131*a* and 131*b* and the common electrodes 132*a* and 132*b* embedded in the intersection regions of the partition wall 140*c*.

As apparent from the description, the scanning electrodes and the common electrodes of the invention are formed in the intersection regions of the partition walls constituting the lattice shape while extending perpendicular to the front substrate. Accordingly, the sufficient aperture ratio can be secured, thereby enhancing the light emitting efficiency. The scanning electrodes and the common electrodes formed in the intersection regions of the lattice have the vertical construction, thereby effectively preventing the phosphors applied to the lower portion of the discharge cell from being damaged by the plasma. The construction of the upper panel can be very simplified, thereby preventing the transmittance from being lowered while increasing the variety of materials which may be used to fabricate the upper panel. The discharge region formed by the scanning electrodes and the common electrodes during operation of the plasma display panel surrounds the selected discharge cell. As a result, the discharge is uniformly performed at the outer periphery of the discharge cell, thereby effectively exciting the phosphors.

It should be understood that the embodiments and the accompanying drawings have been described for illustrative purposes and the present invention is limited only by the following claims. Further, those skilled in the art will appreciate that various modifications, additions and substitutions are allowed without departing from the scope and spirit of the invention as set forth in the accompanying claims.

What is claimed is:

1. A plasma display panel, comprising:

a planar front substrate;

a rear substrate opposite to the front substrate and having address electrodes formed thereon;

partition walls formed to have a lattice shape between the front substrate and the rear substrate;

a phosphor applied to a discharge space partitioned by the partition wall; and a plurality of scanning electrodes and common electrodes each formed in intersecting portions of the partition walls, wherein each electrode has a length, width, and depth, in which the length is greater than the width and the depth, and the length is orthogonal to the front substrate.

2. The plasma display panel as set forth in claim 1, further comprising:

a rear dielectric layer formed on the rear substrate for embedding the address electrodes.

3. The plasma display panel as set forth in claim 1, wherein the scanning electrodes and the common electrodes are disposed alternately such that each of the scanning electrodes is immediately adjacent to each of the common electrodes in the intersecting portions.

4. The plasma display panel as set forth in claim 3, wherein a discharge region is formed between the scanning electrodes and the common electrodes adjacent to each other while surrounding the discharge space partitioned by the partition walls.

5. The plasma display panel as set forth in claim 1, wherein the partition walls constitutes a lattice surrounding the discharge space having a rectangular cross-section, and the scanning electrodes and the common electrodes are disposed in the intersecting portions of the partition walls.

6. The plasma display panel as set forth in claim 1, wherein each of the partition walls comprises an electrode protecting layer for embedding the scanning electrodes and the common electrodes.

7. The plasma display panel as set forth in claim 6, wherein each of the partition walls further comprises a lower partition wall formed between the rear substrate and the electrode protecting layer.

8. The plasma display panel as set forth in claim 6, wherein the electrode protecting layer comprises a dielectric layer.

9. The plasma display panel as set forth in claim 6, wherein the electrode protecting layer comprises an MgO protection film formed at a portion exposed to the discharge space.

10. The plasma display panel as set forth in claim 1, further comprising:

an MgO protection film formed on a rear side of the front substrate.

* * * * *